US010105967B2

(12) United States Patent
Dekel et al.

(10) Patent No.: US 10,105,967 B2
(45) Date of Patent: Oct. 23, 2018

(54) MEDIA SUPPORT

(71) Applicant: HP Scitex Ltd., Netanya (IL)

(72) Inventors: Yaron Dekel, Gan-Yeoshaya (IL); Alex Veis, Kadima (IL); Yuval Dim, Moshav Haniel (IL)

(73) Assignee: HP SCITEX LTD., Netanya (IL)

( * ) Notice: Subject to any disclaimer, the term of this patent is extended or adjusted under 35 U.S.C. 154(b) by 0 days.

(21) Appl. No.: 14/908,190

(22) PCT Filed: Jul. 28, 2013

(86) PCT No.: PCT/IL2013/050639

§ 371 (c)(1),
(2) Date: Jan. 28, 2016

(87) PCT Pub. No.: WO2015/015481

PCT Pub. Date: Feb. 5, 2015

(65) Prior Publication Data

US 2016/0167404 A1 Jun. 16, 2016

(51) Int. Cl.

| | |
|---|---|
| ***B41J 2/165*** | (2006.01) |
| ***B41J 11/00*** | (2006.01) |
| ***B41J 11/06*** | (2006.01) |
| ***B41J 13/00*** | (2006.01) |
| ***B41J 13/22*** | (2006.01) |

(52) U.S. Cl.

CPC ..... *B41J 11/0085* (2013.01); *B41J 11/006* (2013.01); *B41J 11/06* (2013.01); *B41J 13/0072* (2013.01); *B41J 13/226* (2013.01)

(58) Field of Classification Search
None
See application file for complete search history.

(56) References Cited

U.S. PATENT DOCUMENTS 3,306,805 A 2/1967 Klein et al.
3,720,433 A * 3/1973 Rosfelder ..... B66C 1/0243 294/188
3,728,891 A 4/1973 Hall
(Continued)

FOREIGN PATENT DOCUMENTS

CN 1086163 5/1994
CN 1517229 8/2004
(Continued)

OTHER PUBLICATIONS

Andersson,, H. et al.; Evaluation of Coatings Applied to Flexible Substrates to Enhance Quality of Ink Jet Printed Silver Nano-Particle Structures ; IEEE: 342-348; V 2; #2; Feb. 2012.
(Continued)

*Primary Examiner* — Alejandro Valencia
(74) *Attorney, Agent, or Firm* — HP Inc. Patent Department

(57) ABSTRACT

In one example, a media support includes a sheet of suction cups in which each suction cup has a port through which air may be evacuated from the cup. In another example, a detachable cover for a vacuum table includes: a sheet having a flat front surface, a flat back surface and multiple suction cups arranged across the front surface of the sheet Each suction cup has a port to the back surface of the sheet to connect to a corresponding vacuum hole in the table when the cover is attached to the table.

18 Claims, 9 Drawing Sheets

(56) References Cited

U.S. PATENT DOCUMENTS

| | | | | |
|---|---|---|---|---|
| 4,221,356 | A * | 9/1980 | Fortune | B25B 11/005 248/363 |
| 5,671,910 | A | 9/1997 | Davies et al. | |
| 6,182,956 | B1 | 2/2001 | McMillan | |
| 6,346,154 | B1 | 2/2002 | Briend et al. | |
| 6,357,869 | B1 | 3/2002 | Rasmussen et al. | |
| 6,425,565 | B1 | 7/2002 | Montague | |
| 6,543,948 | B2 | 4/2003 | Beehler et al. | |
| 6,571,709 | B1 | 6/2003 | Marincic et al. | |
| 7,597,319 | B2 | 10/2009 | Dangelewicz et al. | |
| 7,922,174 | B2 | 4/2011 | Panides et al. | |
| 8,038,151 | B2 | 10/2011 | Fukui | |
| 8,157,369 | B2 | 4/2012 | Hoover | |
| 8,303,104 | B2 * | 11/2012 | Miyagi | B41J 2/16585 346/139 R |
| 8,398,200 | B2 | 3/2013 | Higuchi | |
| 8,534,826 | B2 | 9/2013 | Kobayashi et al. | |
| 2009/0295898 | A1 | 12/2009 | Takatsuka | |
| 2010/0238249 | A1 | 9/2010 | Panides et al. | |
| 2011/0025796 | A1 | 2/2011 | Matsuya | |
| 2011/0043563 | A1 | 2/2011 | Houjou | |
| 2011/0102531 | A1 * | 5/2011 | Ozaki | B41J 11/0005 347/104 |
| 2011/0115867 | A1 * | 5/2011 | Forgacs | B65H 5/14 347/104 |
| 2011/0292145 | A1 | 12/2011 | Hoover et al. | |
| 2011/0317144 | A1 | 12/2011 | Baxter | |
| 2013/0162742 | A1 | 6/2013 | Inoue et al. | |
| 2014/0049590 | A1 | 2/2014 | Tateishi et al. | |
| 2014/0160213 | A1 * | 6/2014 | Atwood | B41J 11/06 347/101 |

FOREIGN PATENT DOCUMENTS

| | | |
|---|---|---|
| CN | 101676106 | 3/2010 |
| CN | 201501166 | 6/2010 |
| CN | 101870204 | 10/2010 |
| CN | 102019769 | 4/2011 |
| CN | 102431293 | 5/2012 |
| JP | 9166928 | 6/1997 |
| JP | H10520 | 1/1998 |
| JP | 2009107768 | 5/2009 |
| JP | 2012056097 | 3/2012 |
| WO | WO-9014952 | 12/1990 |
| WO | WO-2010008390 | 1/2010 |
| WO | WO-2012147760 | 11/2012 |

OTHER PUBLICATIONS

ODGS S & S, Vancouver ; How to Hold Media Flat on the Printer Table ; https://dgs.oce.com/PrinterSupport/Arizon ; Jun. 11, 2007~3 pags.

PCT Search Report/Written Opinion~Application No. PCT/IL2013/050639 dated Apr. 24, 2014~16 pages.

Yi-ming, W. et al. ; Research on Inverse Seeking Designing Method for Suction Nozzle of Paper Separation Mechanism ; http://en.cnki.com.cn: 2005~3 pgs.

* cited by examiner

MEDIA SUPPORT

BACKGROUND

Large format inkjet punters use vacuum tables to hold down foamboard, cardboard and other inflexible or semi-flexible print media for printing. High capacity vacuum pumps are used to develop the hold down forces needed to keep large sheets of such media flat during printing.

DRAWINGS

The same part numbers designate the same or similar parts throughout the figures.

DESCRIPTION

Corrugated cardboard is widely used to make boxes. Although inkjet printers can print high quality images on corrugated cardboard, it is difficult to hold down corrugated cardboard flat in the print zone for high quality inkjet printing. Consequently, special, more expensive corrugated boards are often used for inkjet printing. A new print media support has been developed to hold down regular, less expensive corrugated cardboard flat for inkjet printing. The new media support uses a sheet of suction cups overlaid on a vacuum table to increase the hold down force applied to corrugated cardboard and other print media. In one example of the new media support, suction cups are embedded in a detachable cover that can be installed over the printer's vacuum table for printing on corrugated cardboard and removed from the printer's vacuum table for printing on other media. Each suction cup has a port aligned to a vacuum hole on the table so vacuum may be applied to the suction cups through the vacuum holes. This and other examples of the new print media support may be used with existing vacuum tables, thus enabling retrofitting printers already in use for high quality printing on corrugated cardboard.

These and other examples are shown in the figures and described below with reference to supporting print media in an inkjet printer. Examples of the new media support, however, are not limited to inkjet printing or to supporting print media, but may be implemented to support other types of media and for applications other than inkjet printing.

Accordingly, the examples shown and described illustrate but do not limit the invention, which is defined in the Claims following this Description.

Figure 1:
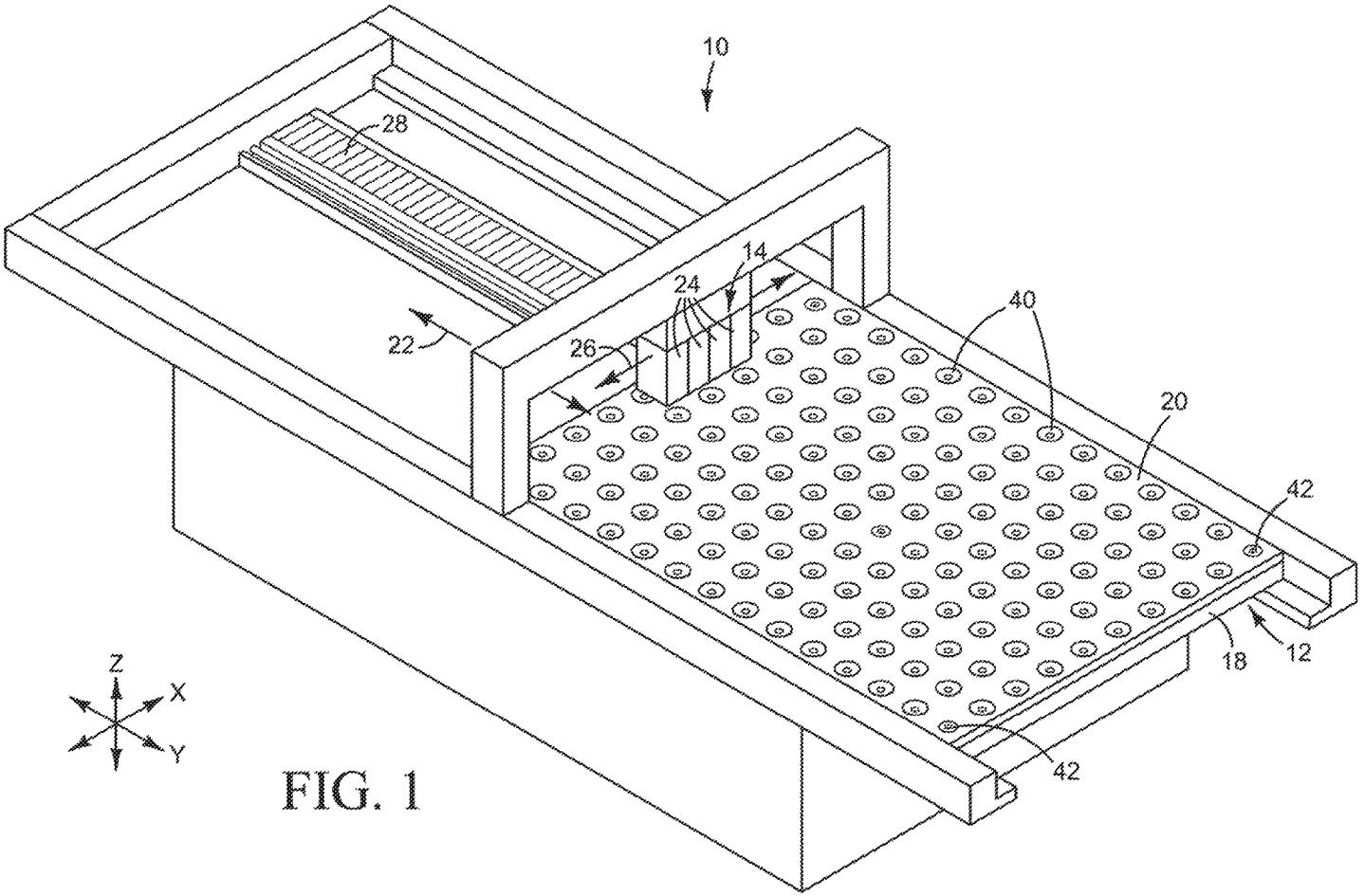
FIGS. 1 and 2 are perspective and elevation views illustrating an inkjet printer implementing one example of a new media support that includes a detachable suction cup sheet.
Figure 2:
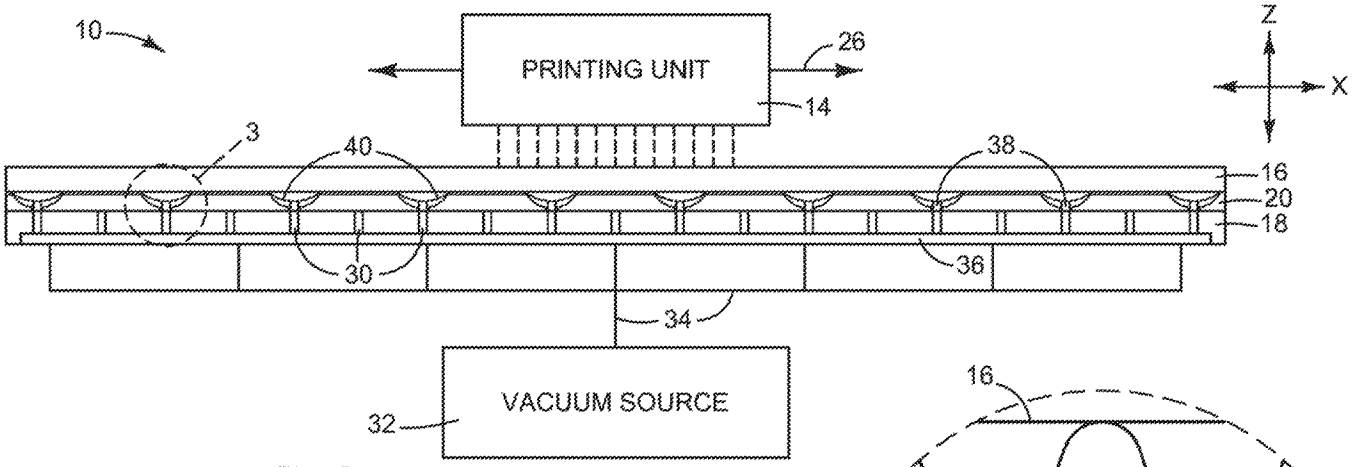
Figure 3:
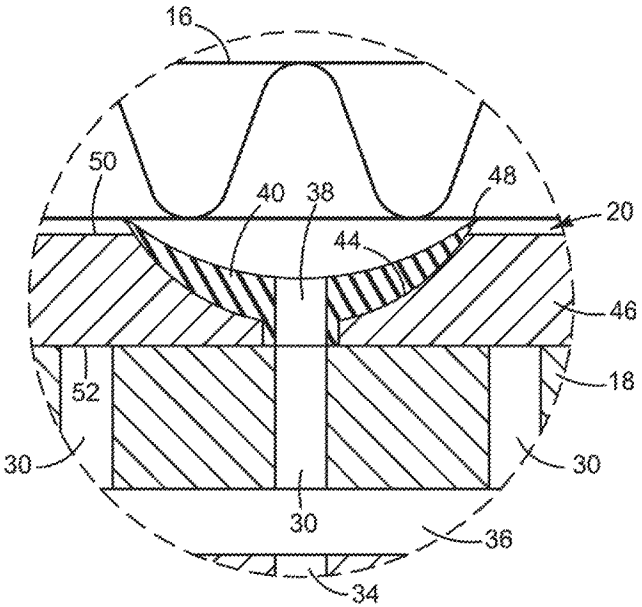
FIG. 3 is a detail from FIG. 2 showing one of the suction cups.
Figure 4:
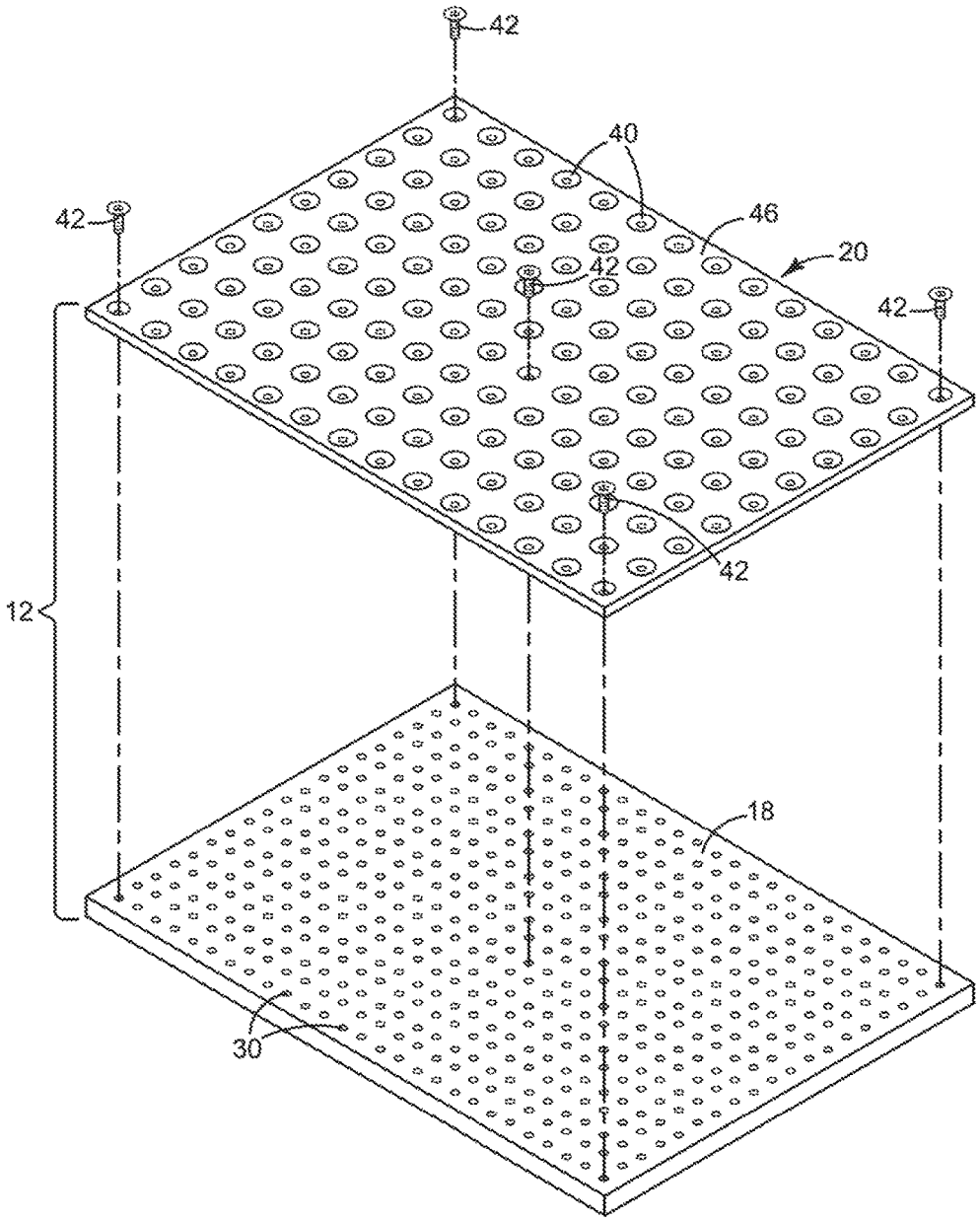
FIG. 4 is an exploded view of the media support in the printer shown in FIGS. 1 and 2.

FIG. 1 illustrates an inkjet printer 10 implementing one example of a new media support 12. FIG. 2 is an elevation view illustrating a media support 12 in printer 10. FIG. 3 is a blow-up from FIG. 2 showing part of media support 12 in more detail. FIG. 4 is an exploded view of media support 12. Referring to FIGS. 1-4, printer 10 includes a printing unit 14 positioned over media support 12 supporting a sheet of corrugated cardboard or other print media 16 (FIG. 2). Print media 16 is omitted from FIG. 1 to better illustrate media support 12. Media support 12 includes a vacuum platen 18 and a suction cup sheet 20 covering platen 18. In the example shown, vacuum platen 18 is configured as a movable, flat plate to support large size print media 16. This type of vacuum platen is commonly referred to as a vacuum table. Vacuum table 18 is moved in the Y direction back and forth under printing unit 14 on a track or other suitable drive system 28, as indicated by arrows 22 in FIG. 1. Also in the example shown, punting unit 14 is configured as a group of inkjet pens 24 scanned back and forth over media 16 in the X direction, as indicated by arrows 26 in FIG. 1. Other suitable configurations are possible. For example, vacuum platen 18 could be configured as a pallet system such as that described in international patent application PCT/US11/24372 filed Feb. 10, 2011 and titled Media Transport Assembly or as a rotating drum (covered by a flexible sheet 20), and/or printing unit 14 could be configured as a media wide array of stationary ink pens.

Holes 30 in vacuum table 18 are operatively connected to a pump or other vacuum source 32 through a network of tubes 34, plenum(s) 36, and controls (not shown). A port 38 at the back of each suction cup 40 is aligned with a vacuum hole 30 when sheet 20 is installed on table 18. In operation, air is evacuated from cup 40 through port 38 under negative pressure from pump 32 to apply suction to print media 16. Any suitable removable fastener 42 may be used to attach sheet 20 to table 18 including, for example, adhesives, magnets or screws 42 shown in FIGS. 1 and 4 countersunk into the front surface of suction cup sheet 20. While it is expected that a detachable sheet 20 will be desirable for most implementations, a suction cup sheet 20 could be affixed to table 18 in a manner designed to be not easily detached from table 18.

Referring now specifically to the detail view of FIG. 3, in the example shown, each suction cup 40 is configured as a discrete part embedded in a recess 44 in a body part 46 of sheet 20. Also, in the example shown in FIG. 3, a flexible rim 48 of each suction cup 40 protrudes slightly above the front surface 50 of sheet body 46 to help seal each cup 40 tightly against print media 16 when suction is applied to cups 40, increasing the hold down force applied to print media 16. A flat back surface 52 of sheet body 46 contacts a similarly flat vacuum table 18.

Figure 5:
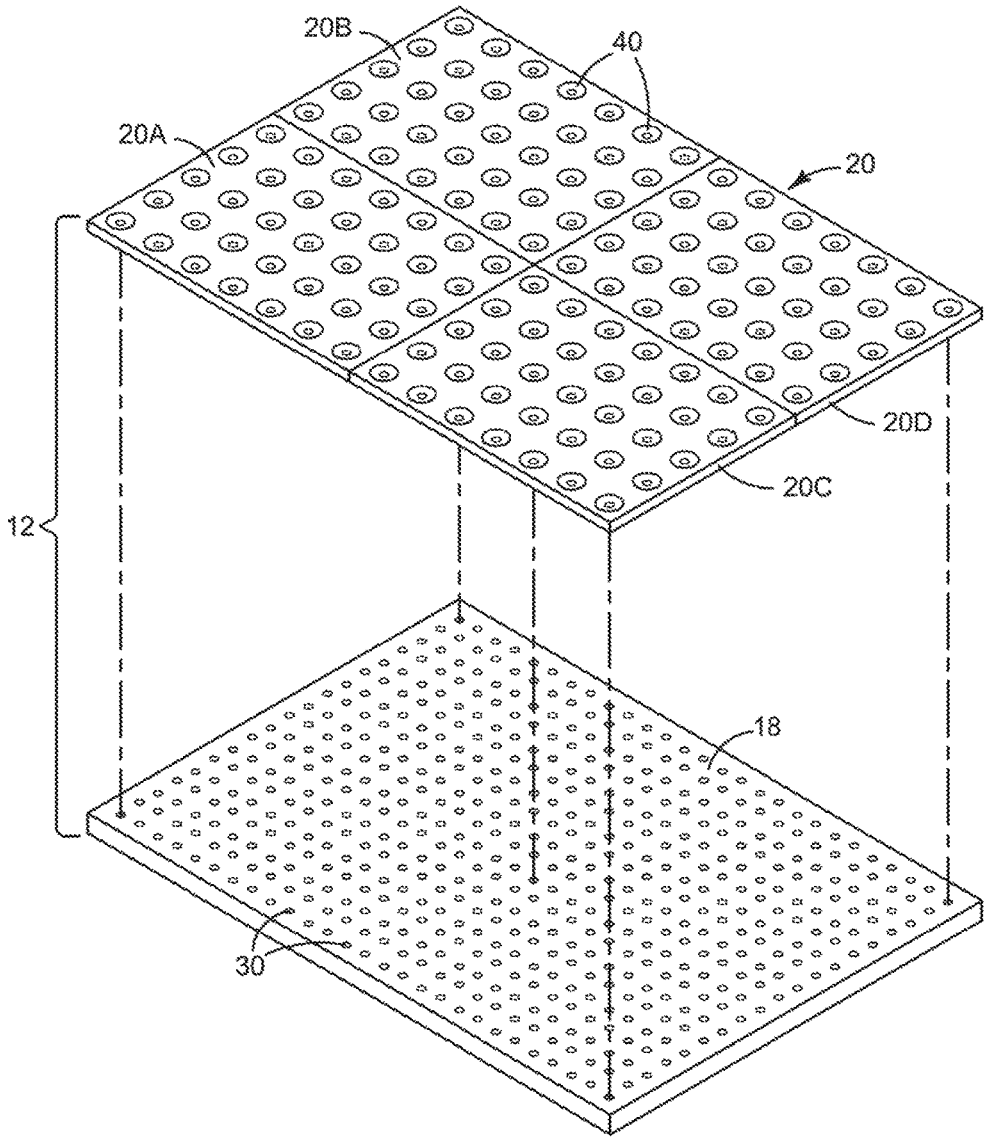
FIG. 5 is an exploded view of a media support such as that shown in FIG. 4 in which the suction cup sheet is configured as an assembly of multiple sections.
Figure 6:
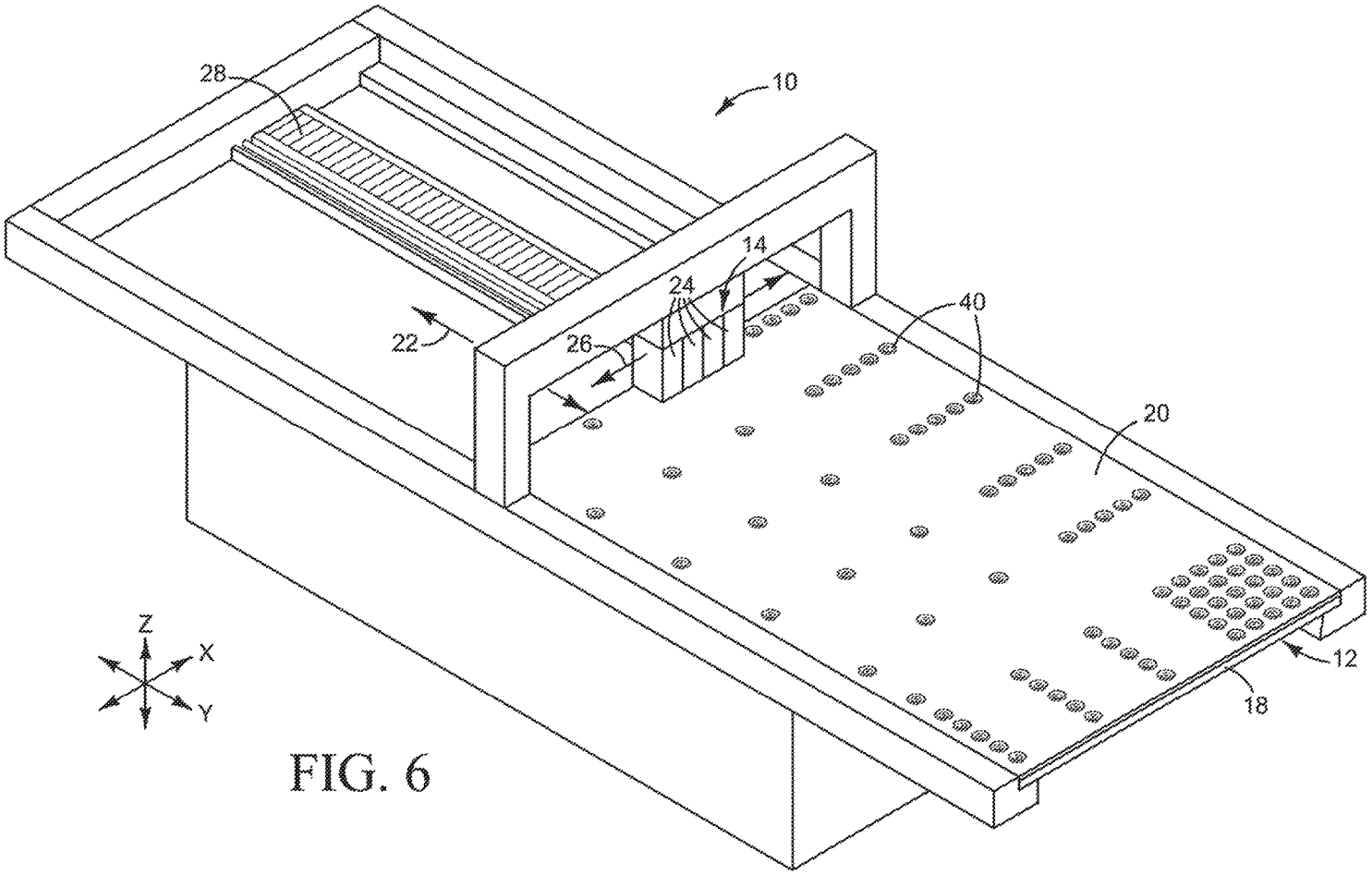
FIGS. 6 and 7 are perspective and elevation views illustrating an inkjet printer implementing another example of a new media support that includes a detachable suction cup sheet.

FIG. 5 is an exploded view of a media support 12 in which suction cup sheet 20 is configured as an assembly of multiple sections 20A, 20B, 20C, 20D. It may not be desirable or even practical in some implementations of a media support 12 to form sheet 20 as a single sheet. For example, it may not be practical to fabricate a single sheet 20 to cover very large vacuum tables 18 used in some industrial printers. For another example, it may be desirable in some implementations to utilize multiple sections to more easily adapt a suction cup sheet 20 to different size vacuum platens 18.

FIGS. 6-10 illustrate another example of a media support 12 with a detachable suction cup sheet 20. In the example shown in FIGS. 6-10, each suction cup 40 is molded into or otherwise formed as an integral part of sheet body 46. Referring specifically to the detail views of FIGS. 8 and 9, each suction cup 40 includes a flexible ring 54 suspended in a recess 56 with rim 48 protruding slightly above front surface 50 of body 46 so that cup 40 can flex as suction is applied to print media 16. Rim 48 is formed at the perimeter of ring 54 which surrounds port 38 in space such that ring 54 may flex into recess 56 away from front surface 50 when print media 16 is sucked onto rim 48. Flexible rings 54 help suction cups 40 conform to any waves, undulations and other irregularities typical of corrugated cardboard print media 16 so that each cup 40 maintains a better seal to increase the hold down force.

Each cup 40 also includes a series of flat ridges 58 that project radially from vacuum port 38. Suction pulls print media 16 down onto the surface of ridges 58 as ring 54 flexes into recess 56. Although any suitable material and fabrication technique may be used to form sheet 20, it is expected that a molded plastic sheet 20 will be desirable and cost effective for most printer implementations. For some implementations, for example covering a flat vacuum table, a rigid sheet body 46 may be desirable. For other implementations, for example covering a drum platen, a flexible sheet body 46 may be desirable.

Also, in the example shown in FIGS. 6-10, suction cups 40 are arranged on body 46 in a pattern 60 that includes a first, more dense array 62 of suction cups 40 and a second, less dense array 64 of suction cups 40. The suction cups 40 in arrays 62, 64, and thus the corresponding vacuum holes 30 in table 18, are configured to minimize the number of vacuum holes 30 and suction cups 40 needed to deliver the desired hold down forces to print media 16, as described in detail in International Patent Application No. PCT/IL2012/050220 filed Jun. 25, 2012 titled Vacuum Hole Array. In this example, the number and pattern of suction cups 40 on sheet 20 match the number and pattern of vacuum holes 30 on table 18. Other suitable configurations are possible, for example with fewer suctions cups 40 arrayed differently from holes 30.

Figure 7:
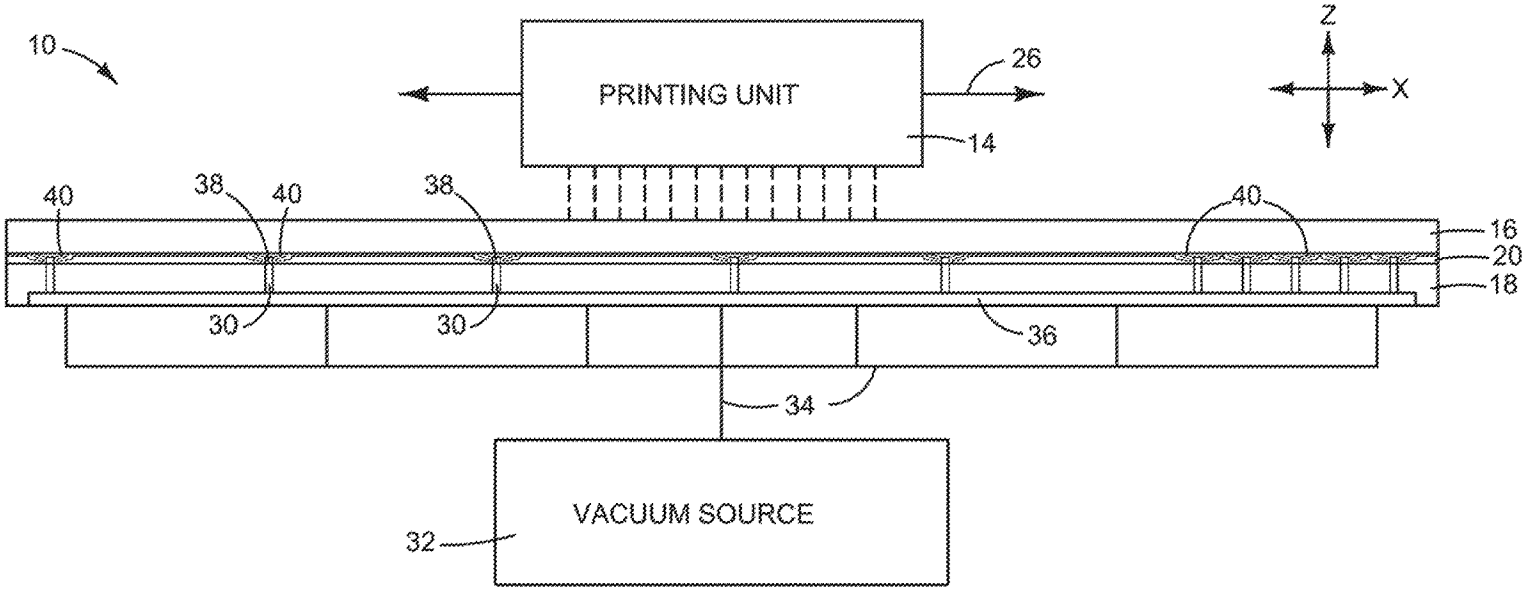
Figure 8:
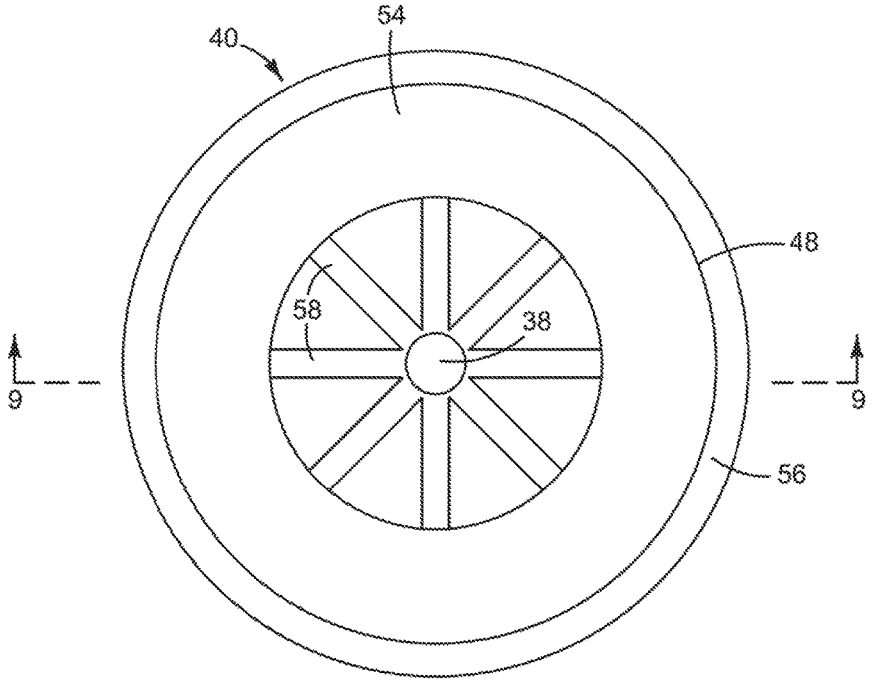
FIGS. 8 and 9 are plan and section views, respectively, showing a suction cup from the sheet of FIGS. 5 and 6 in more detail.
Figure 9:
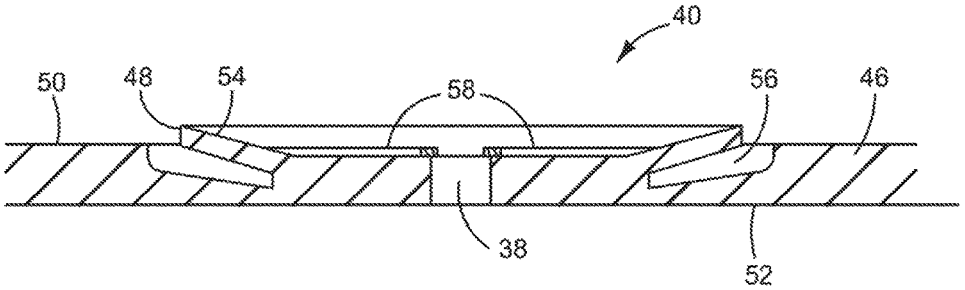
Figure 10:
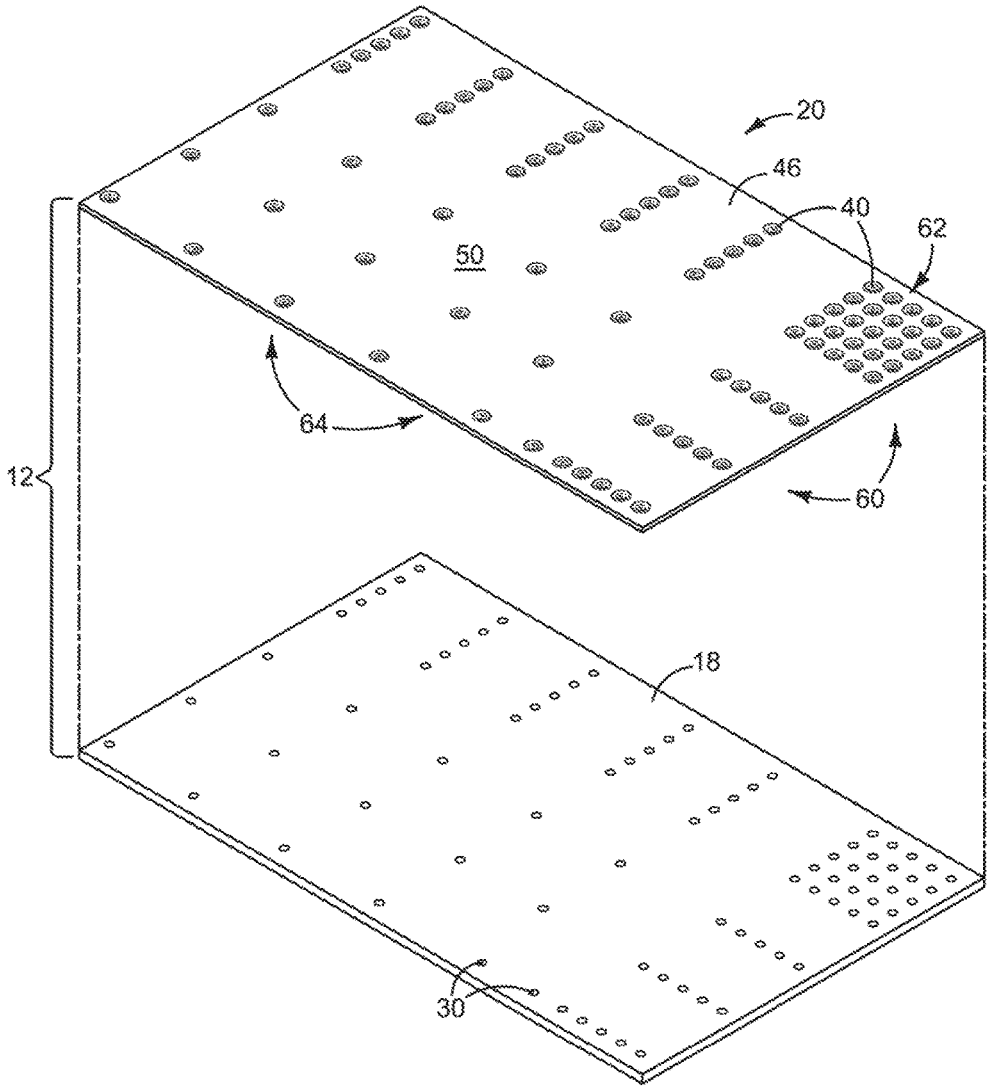
FIG. 10 is an exploded view of the media support in the printer shown in FIGS. 6 and 7.
Figure 11:
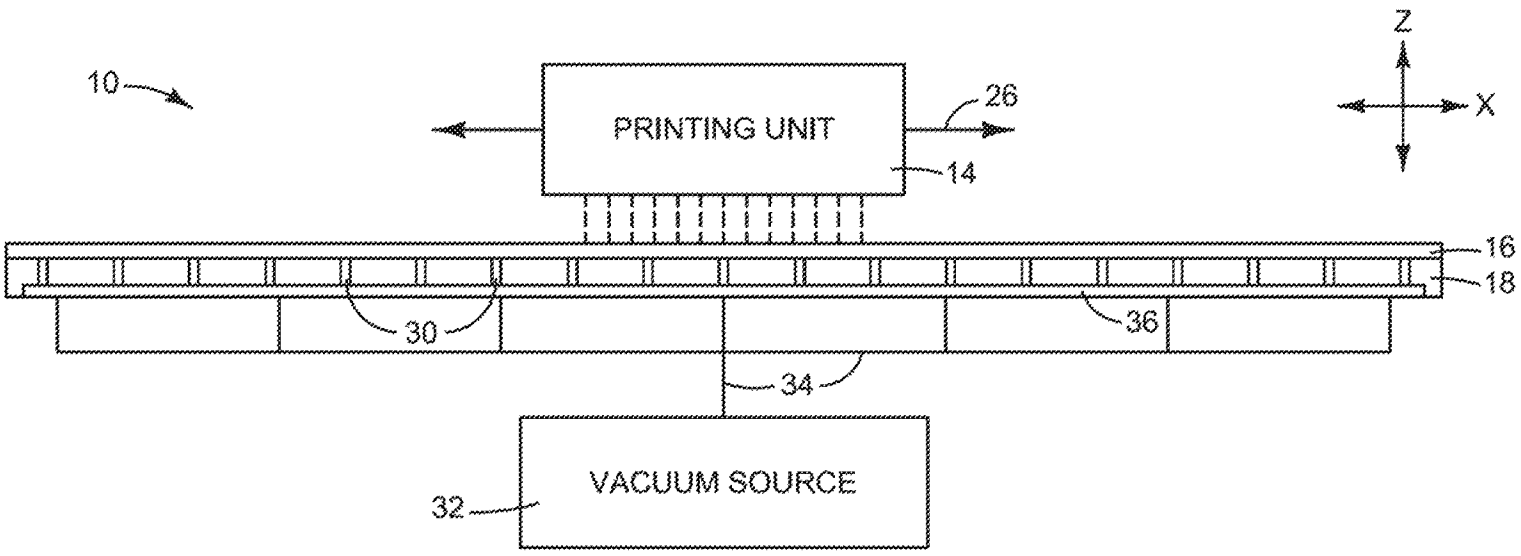
FIG. 11 is an elevation view illustrating the media support in the printer shown in FIGS. 1 and 2 with the suction cup sheet detached from the vacuum table.

Testing indicates that, for the same vacuum line pressure, the hold down force applied by a suction cup 40 such as that shown in FIGS. 8 and 9 that is 10 mm-50 mm in diameter is more than 10 times greater than the hold down force applied by a vacuum hole 30 that is 2 mm-5 mm in diameter alone. Thus, significantly greater hold down forces may be applied, and through fewer vacuum holes if desired. For example, and referring to FIG. 4, the array 52 of suction cups 40 on sheet 20 may be substantially less dense than the array 54 of vacuum holes on table 18. In addition, suction cup sheet 20 may be fitted to existing vacuum tables. Accordingly, large format printers already in use may be inexpensively retrofitted with detachable suction cup sheets 20 to more effectively print on corrugated cardboard. Where suction cups are not desired for printing, sheet 20 is not installed (or is removed if already installed) and print media 16 is placed directly on vacuum table 18, as shown in FIG. 11. Where suction cups are desired for printing, sheet 20 is installed on table 18 and print media 16 is placed on sheet 20, as shown in FIGS. 2 and 7.

As noted at the beginning of this description, the examples shown in the figures and described above illustrate but do not limit the invention. Other forms, details, and examples may be made and implemented. Therefore, the foregoing description should not be construed to limit the scope of the invention, which is defined in the following claims.

What is claimed:

1. A media support, comprising:

a vacuum platen having:

an upper surface to receive a sheet of media; and an array of holes in the vacuum platen;

a sheet comprising an array of suction cups covering the vacuum platen, wherein the cups open away from the upper surface to receive a sheet of media, each cup having a port through which air may be evacuated from the cup to secure a sheet of media to the vacuum platen, wherein the array of suction cups is less dense than the array of holes; and a drive system to move the vacuum platen with respect to a printing unit.

2. The media support of claim 1, wherein the sheet is fastened to the vacuum platen.

3. The media support of claim 1, wherein each suction cup is an integral part of the sheet.

4. The media support of claim 1, wherein the sheet comprises a flexible sheet.

5. The media support of claim 1, wherein the sheet includes a front surface and a back surface and each suction cup includes a rim that protrudes above the front surface of the sheet.

6. A media support, comprising a sheet of suction cups each having a port through which air may be evacuated from the cup;

wherein the sheet includes a front surface and a back surface and each suction cup includes a rim that protrudes above the front surface of the sheet;

wherein the rim is formed at the perimeter of a flexible ring surrounding the port in space such that the ring flexes into a recess on the front surface of the sheet when a media supported on the sheet is sucked onto the rim; and wherein the number of suction cups is less than the number of holes on a vacuum platen.

7. The media support of claim 6, wherein each suction cup includes multiple ridges each extending radially out from the port toward the rim.

8. The media support of claim 1, further comprising:

a platen having an array of vacuum holes therein through which vacuum may be applied to media on the platen;

wherein the sheet is disposed covering the platen, the sheet having a body, the suction cups formed in an array in the body with the port of each suction cup being aligned to a vacuum hole on the platen so that vacuum may be applied to the suction cup through the vacuum hole.

9. The media support of claim 8, wherein the sheet is detachable from the platen.

10. The media support of claim 8, further comprising a fastener attaching the sheet to the platen.

11. The media support of claim 8, wherein there are the same or fewer suction cups on the sheet than vacuum holes in the platen.

12. The media support of claim 8, wherein each suction cup includes a flexible ring surrounding the port in a recess such that the ring may flex into the recess when suction is applied to print media supported on the sheet.

13. The media support of claim 1, further comprising a detachable cover for a vacuum table, wherein:

the sheet has a flat front surface and a flat back surface; and the suction cups are arranged across the front surface of the sheet, the port of each suction cup being in the back surface of the sheet to connect to a corresponding vacuum hole in the table when the cover is attached to the table.

14. The media support of claim 13, wherein:

each suction cup is either a discrete part affixed to the sheet or an integral part of axe sheet; and each suction cup includes a rim protruding above the front surface of the sheet.

15. The media support of claim 13, further comprising a fastener configured to removably attach the cover to the table.

16. The media support of claim 1, wherein the sheet of suction cups is incorporated in a detachable cover for selective installation on, and removal from, a vacuum table.

17. The media support of claim 16, further comprising a removable fastener to removably attach the sheet of suction cups to the vacuum table.

18. The media support of claim 1, wherein the sheet of suction cups comprises suction cups molded into a sheet body.

* * * * *